United States Patent [19]

McNamara et al.

[11] 4,339,150

[45] Jul. 13, 1982

[54] BACK SUPPORT CONSTRUCTION

[75] Inventors: Daniel E. McNamara; Gerald Sinatra, both of Snyder, N.Y.

[73] Assignee: GMSR Ortho Enterprises, Inc., Amherst, N.Y.

[21] Appl. No.: 146,209

[22] Filed: May 5, 1980

[51] Int. Cl.[3] ..... A47C 3/00; A47C 7/02

[52] U.S. Cl. ..... 297/284; 297/460

[58] Field of Search ..... 297/231, 284, 452, 460, 297/230, 353, 384

[56] References Cited

U.S. PATENT DOCUMENTS

| | | | |
|---|---|---|---|
| 2,756,809 | 7/1956 | Endresen | 297/284 |
| 3,608,960 | 9/1971 | Sherman | 297/284 |
| 3,880,463 | 4/1975 | Shephard et al. | 297/284 |
| 3,973,797 | 8/1976 | Obermeier et al. | 297/284 |
| 4,108,492 | 8/1976 | Kerby | 297/284 |
| 4,124,252 | 11/1978 | Sabir | 297/284 |
| 4,153,293 | 5/1979 | Sheldon | 297/284 |

*Primary Examiner*—Patrick D. Lawson

*Attorney, Agent, or Firm*—Joseph P. Gastel

[57] ABSTRACT

A back support construction including a base, upper and lower back support plates of extended surface area, mechanical linkages for positively bodily moving each of the upper and lower back support plates in their entireties independently of each other toward and away from the base while each maintains parallelism with the base, knobs extending laterally from the base for actuating the mechanical linkages, and padding on the upper and lower plates.

12 Claims, 11 Drawing Figures

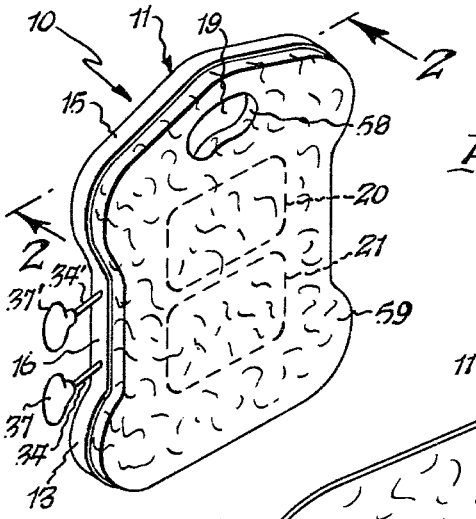
Fig. 1.
Fig. 2.
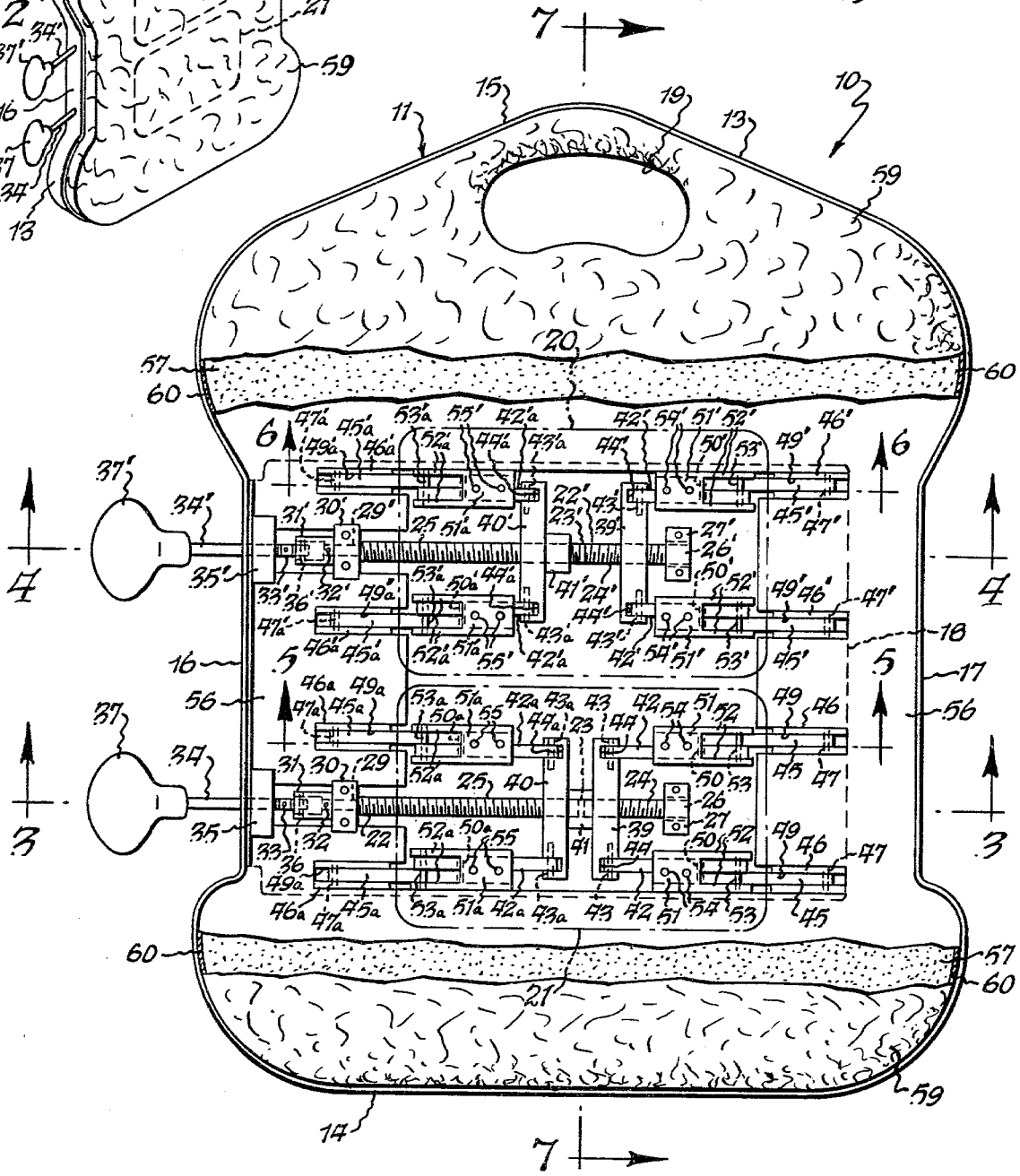

BACK SUPPORT CONSTRUCTION

BACKGROUND OF THE INVENTION

The present invention relates to an improved portable back support construction for a person.

By way of background, there are numerous known back support constructions of the type which are placed between the back of a chair and a person to lend support to specific areas of a person's back. Generally these supports include linkages for causing the back support to exert selectively adjustable pressures against a person's back. However, prior types of back supports were deficient in certain respects in that they did not provide two vertially spaced pressure areas which could be adjusted independently of each other, or they possessed rather complicated linkages, or they did not provide extended surface areas at which the back was supported. It is with providing an improved back support which is not subject to the foregoing shortcomings that the present invention is concerned.

SUMMARY OF THE INVENTION

It is accordingly one object of the present invention to provide an improved back support having at least one extended surface area which supports a substantial area of a person's back and which can be moved toward and away from a person's back to provide the desired degree of support thereto, while maintaining the same orientation relative to the person's back in all positions.

It is another object of the present invention to provide an improved back support having a pair of vertically spaced back support areas which can be adjusted toward and away from a person's back independently of each other. Other objects and attendant advantages of the present invention will readily be perceived hereafter.

The improved adjustable back support of the present invention comprises a base, a back support plate defining a surface area for placement in contiguous relationship to a person's back, and linkage means for bodily moving said back support plate toward and away from said base while maintaining said back support plate in substantially the same orientation relative to said base in all positions of said back support plate. In its more specific aspect, the adjustable back support includes first and second vertically spaced back support plates each defining a surface area for placement in contiguous relationship to a person's back, and mechanical linkage means for positively bodily moving said first and second back support plates in their entireties independently of each other toward and away from said base to thereby provide two vertically spaced surface areas entirely independent of each other at selectively variable distances from said base for supporting the back of a person. The various aspects of the present invention will be more fully understood when the following portions of the specification are read in conjunction with the accompanying drawings wherein:

BRIEF DESCRIPTION OF THE DRAWINGS

FIG. 1 is a diminutive perspective view of the improved back support of the present invention;

FIG. 2 is a cross sectional view, partially broken away in layers, taken substantially along line 2—2 of FIG. 1 and showing the linkages for moving the vertically spaced back support plates independently of each other;

DESCRIPTION OF THE PREFERRED EMBODIMENTS

Figure 3:
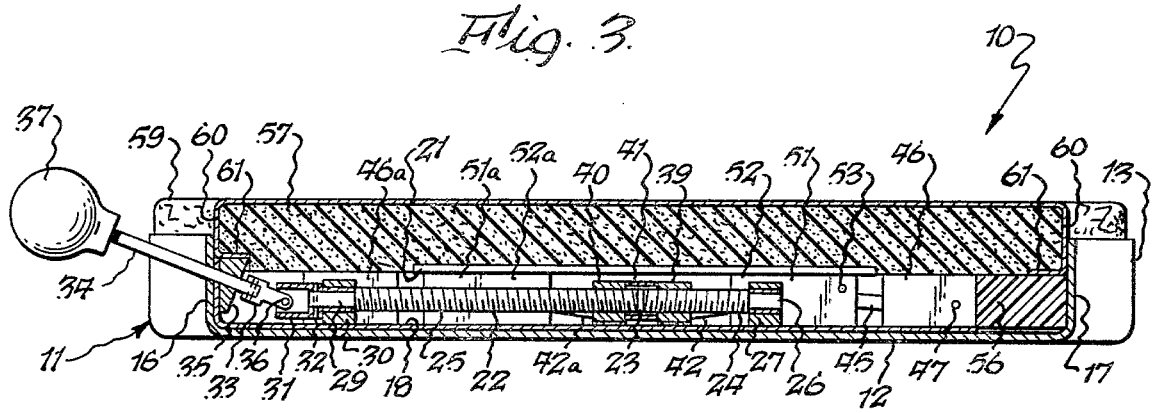
FIG. 3 is a cross sectional view taken substantially along line 3—3 of FIG. 2 and showing the lower back support plate in its fully retracted position.

The improved back support 10 of the present invention is for use as a back rest on an automobile seat or on a chair when it is desired to support the back of a person by one or more extended surface areas which may be adjusted as to the amount they project toward the person's back. The extended surface areas are areas which are relatively large as compared to the area of a person's spine. By way of example, and not of limitation, each extended area, as disclosed, is approximately 33 square inches which is obtained from a plate which is approximately 4.75 inches by 7 inches, but the area can vary, and can even be decreased by reducing the height of the plates to as little as about two inches. The significant factor is that a relatively large area is maintained in supporting relationship to a person's back and spine.

The back support 10 includes a base or casing 11 having a planar rear wall 12 and a peripheral upstanding rim 13 consisting of end wall portions 14 and 15 and side wall portions 16 and 17 which are suitably connected by curved rim portions (not numbered) so that rim 13 is continuous around the entire edge of rear wall 12. Base 11 is preferably fabricated from molded plastic. A hand hole is formed in base 11 by inturned rim 19 formed integrally with the remainder of base 11.

To provide vertically spaced extended surface areas of support for a person's back, upper back support plate 20 and lower back support plate 21 are mounted on base 11 by identical linkages. Since these linkages are identical, the lower linkage will be described in detail by the use of certain numerals, and corresponding parts of the upper linkage will be designated by identical numerals which are primed. Thus, the primed and unprimed numerals designate identical elements of structure on the upper and lower linkages, respectively, which mount back support plates 20 and 21, respectively. This being the case, it will be appreciated that a detailed description of the lower linkage will obviate the necessity to provide a detailed description of the upper linkage because they are identical.

The linkage for varying the position of lower plate 21 relative to rear wall 12 basically comprises a shaft 22 which includes a central portion 23. Threads of one hand 24 are located on one side of central portion 23 and threads 25 of the opposite hand are located on the opposite side of said central portion 23. Shaft 22 includes an end portion 26 which is journalled in bearing block 27 suitably secured to rear wall 12 as by screws (not shown). The end portion 29 of shaft 22 is journalled in bearing block 30 secured to the rear wall 12 by suitable screws (not shown). A sleeve 31 is pinned to shaft 22 at 32, and fitting 33 (FIG. 3) is secured to the end of shaft 34 which is journalled in block 35 secured to rim portion 16 by screws (not shown). Fitting 33 is pinned at 36 to sleeve 31 to provide a universal connection. A knob 37 is located at the end of shaft 34, and when knob 37 is rotated, this rotation will be imparted to shaft 22.

Yoke members 39 and 40 are tapped to receive oppositely threaded portions 24 and 25, respectively, so that when shaft 22 is rotated, yoke members 39 and 40 will move in opposite directions along back 12. An annular spacer 41 is loosely mounted on shaft 22 to limit the amount that yokes 39 and 40 can move toward each other. A first pair of identical parallel links 42 have first ends which are pivotally connected to yoke 39 by pins 43, and the ends of links 42 fit in slots 44 in yoke 39. A pair of identical parallel links 45 have first ends which are pivotally secured to blocks 46 by pins 47, with the ends of links 45 fitting within slots 49 of blocks 46. Blocks 46 are fixedly secured to back 12 by suitable screws (not shown). Each pair of links 42 and 45 are pivotally secured to each other by a pin 50. Bifurcated plate attachment blocks 51 include side portions 52 which straddle links 42 and 45 and are pivotally connected to link 42 by pin 53 which extends through the end of link 42 and spaced legs 52. The side portions 52 of attachment block 51 bear on the outer sides of the links 42 and 45 therebetween, to assist in maintaining them in proper alignment.

The links and related structure associated with yoke 40 are mirror image counterparts of the links and structure associated with yoke 39, and such mirror image counterparts are designated by the same numerals as the links and parts associated with yoke 39, except that they bear the postscript a. Therefore, a detailed description of the structure associated with yoke 40 will be omitted. Also, as noted above, the linkage associated with upper plate 20 is identical to the linkage associated with lower plate 21, and corresponding links of plate 20 will be designated with primed numerals which correspond to the unprimed numerals associated with the linkage for plate 21.

Figure 4:
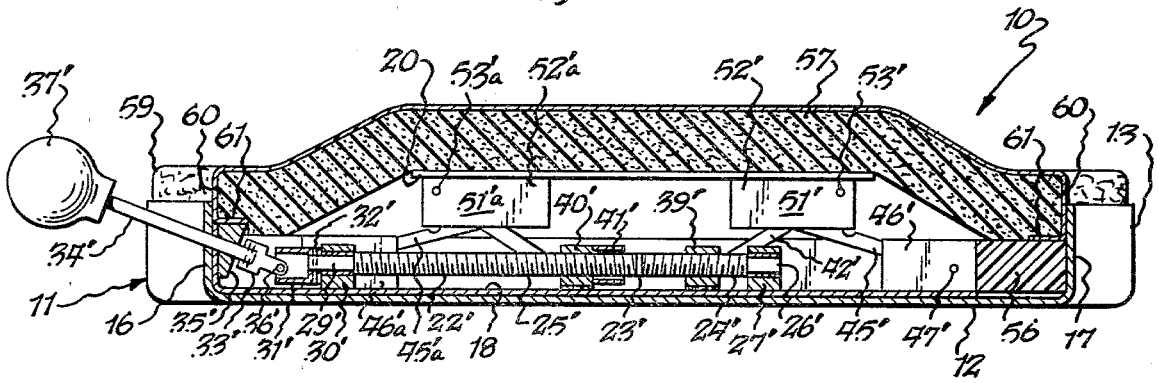
FIG. 4 is a cross sectional view taken substantially along line 4—4 of FIG. 2 and showing the upper back support plate in an extended position.
Figure 5:
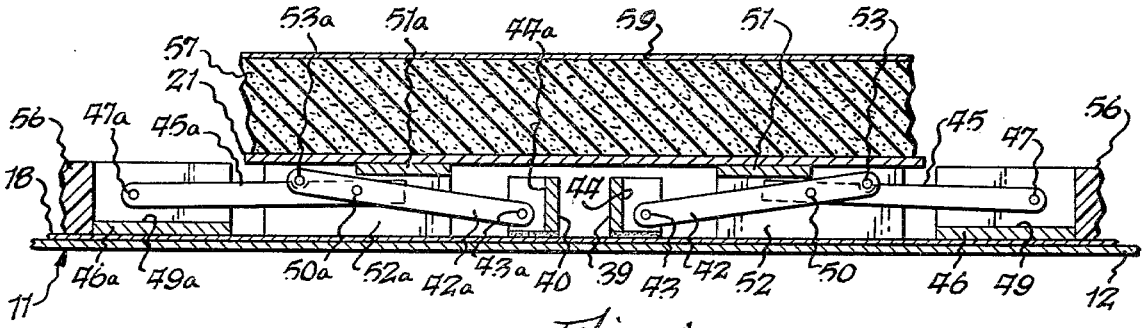
FIG. 5 is a fragmentary enlarged cross sectional view taken substantially along line 5—5 of FIG. 2 and showing the position which certain of the links assume when the lower back support plate in its fully retracted position.
Figure 6:
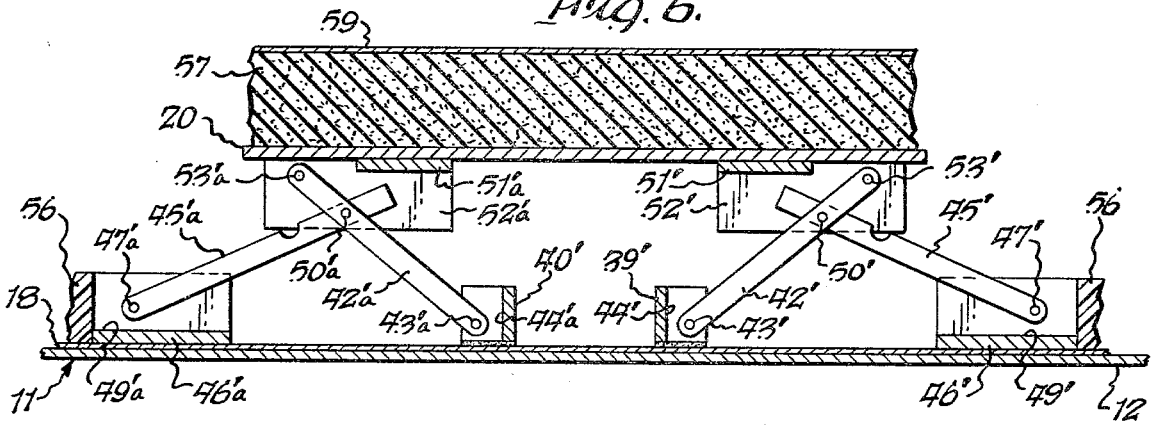
FIG. 6 is a fragmentary cross sectional view taken substantially along line 6—6 of FIG. 2 and showing the position which certain of the links assume when the upper back support plate is in an extended position.

The links associated with yoke 40 will move, in mirror-image relationship, in a direction opposite to the links associated with yoke 39. When shaft 22 is rotated in one direction, yoke 39 and 40 will move away from each other in FIG. 2, and when shaft 22 is rotated in the opposite direction, yokes 39 and 40 will move toward each other. When yokes 39 and 40 move away from each other, links 42 and 42*a* will move toward the positions shown for links 42' and 42'*a*, respectively, in FIG. 6, and links 45 and 45*a* will move toward the position shown for links 45' and 45'*a*, respectively, in FIG. 6. This will cause attachment blocks 51 and 51*a* to move toward the positions shown for blocks 51' and 51'*a* in FIG. 6. Plate 21 is attached to attachment blocks 51 by rivets 54 and is attached to attachment blocks 51*a* by rivets 55. Thus, as can be visualized, plate 21, which is shown in its fully retracted position in FIGS. 3 and 5 can be moved to an extended position shown for back support 20 in FIGS. 4 and 6.

Figure 7:
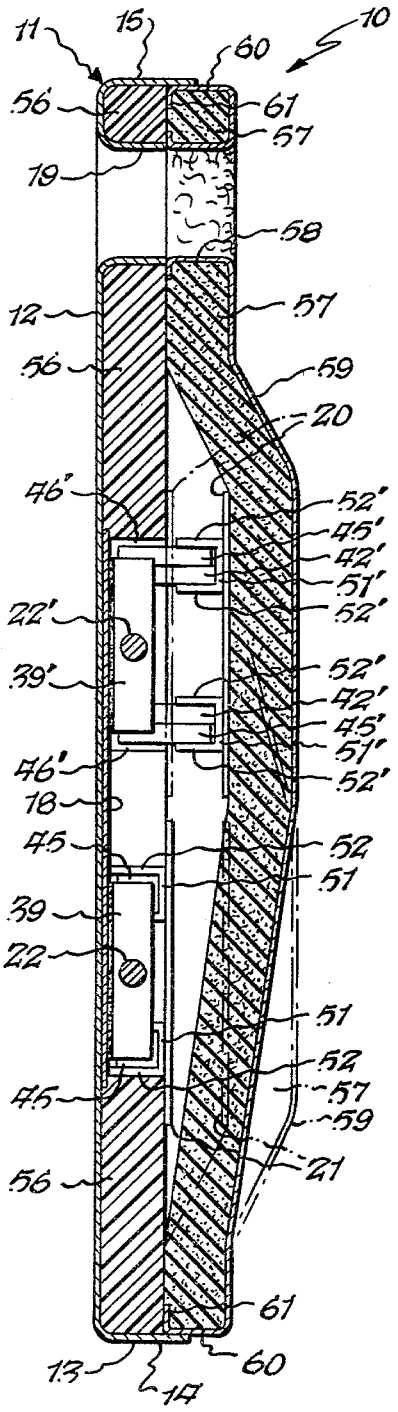
FIG. 7 is a cross sectional view taken substantially along line 7—7 of FIG. 2.

It will be associated that back support plates 20 and 21 can be moved to any desired extended position away from base 12 by manipulating knobs 37 and 37' to thereby effect rotation of the shafts associated therewith. In FIG. 7, the dotted line position of plate 21 is the extended position, and the solid line position of plate 21 is the retracted position; and the solid line position of plate 20 is the extended position, and the dotted line position of plate 20 is the retracted position. It will also be appreciated that since the knobs 37 and 37' extend laterally from the side of the back support 10, the adjustment of back support plates 20 and 21 may be effected while the person is resting against the back support, to thereby adjust the position of each back support plate 20 and 21 for maximum comfort. Back support plates 20 and 21 are each completely independently movable with respect to each other so that movement of one does not affect the movement of the other. It is to be especially noted that in all positions to which plates 20 and 21 may be adjusted, they are perfectly parallel to rear wall 12 of base 11, as shown in FIG. 7, and since rear wall 12 in use is oriented substantially parallel to the back of a chair, plates 20 and 21 will always be substantially parallel to the back of the chair, to thereby support the person's back with their full faces.

In addition to the foregoing construction relating to the back support plates and its associated linkage, the back support 10 includes the following structure. First of all, a reinforcing plate 18 of the same size and shape as back 12 is laid against back 12 to impart rigidity thereto. However, this plate is optional. Laid on back 12 and on portions of plate 18 is a styrofoam pad 56. The outer edges of pad 56 lie in contiguous relationship to upstanding rim 13. Pad 56 thus covers the entire back 12 except for the areas in which the movable links are located, as can be seen from FIGS. 2 and 7. The styrofoam pad 56 is held in position by glue. Laid on top of the styrofoam and on top of back support plates 20 and 21 is a sheet 57 of foam rubber-like material which can stretch from the position shown in FIG. 3 to the position shown in FIG. 4, as back support plates 20 and 21 move from their retracted positions to their extended positions. Foam material 57 extends throughout the entire distance within rim 13 except for a portion which is cut out at 58 (FIGS. 1 and 7), and thus foam 57 cushions the entire front of the support. Only the edge portions approximately 1 inch inwardly from rim 13 are cemented to styrofoam pad 56. Overlying foam plate 57 is a stretchable knit cover 59 which is adhesively secured to the edges 60 of foam sheet 57 and is tucked in beneath the foam sheet 57 at 61.

Figure 8:
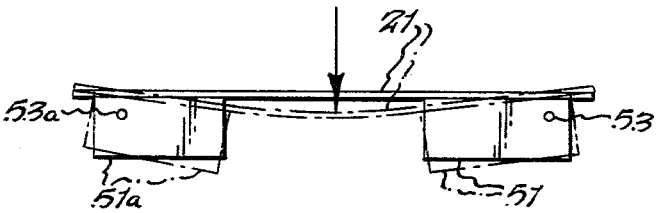
FIG. 8 is a schematic view showing a flexible resilient back support plate.
Figure 9:
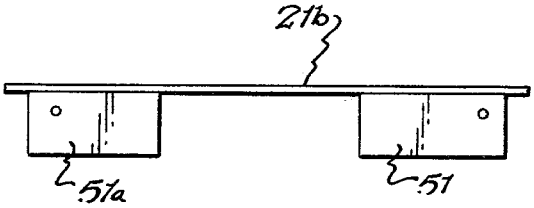
FIG. 9 is a schematic view showing a rigid planar back support plate.
Figure 10:
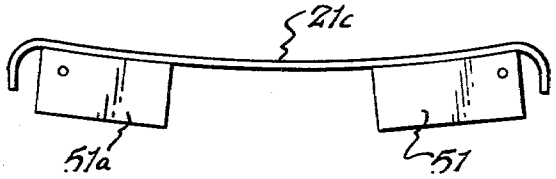
FIG. 10 is a schematic view showing a curved rigid back support plate.
Figure 11:
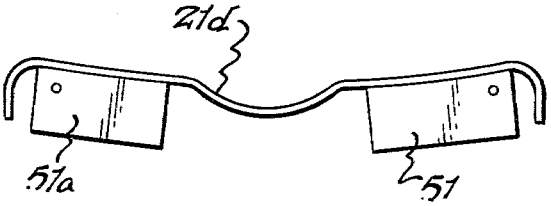
FIG. 11 is a perspective view showing a compound curved rigid back support plate.

Back support plates 20 and 21 (FIG. 8) are resiliently flexible. Attachment blocks 51 and 51*a*, which mount plate 21, are pivotally mounted at the ends of links 42 and 42*a* by pins 53 and 53*a*. Therefore, plate 21 can flex about a vertical axis from the solid line to the dotted line position shown in FIG. 8 to accommodate the curvature of a person's back. Plate 20, which is mounted on attachment blocks 51' and 51'*a*, is also flexible and resilient and is mounted in the same manner and can also provide the same results. However, in certain circumstances it may be desirable to utilize a plate, such as 21*b* of FIG. 9, which is rigid. Alternatively, it may be desirable under certain circumstances to utilize a rigid curved plate 21*c*, such as shown in FIG. 10, to accommodate the curvature of a person's back. As still a further modification, it may be desirable to utilize a compoundly curved back support plate such as shown in 21*d* in FIG. 11. It will be appreciated that the above described linkage lends itself to supporting a plate of any desired degree of rigidity or flexibility and of any desired shape, as may be required. This is because the geometry of the supporting linkage is such that as the yokes 39 and 40 (and their counterparts 39' and 40') move toward and away from each other, pivot pins 53 and 53*a* at the ends of links 42 and 42*a*, respectively, will move along lines which are perpendicular to back 12, which in turn causes attachment blocks 51 and 51*a* to do the same.

By way of dimensions, the back support 10 is approximately 13½ inches wide at the midpoint and approximately 19 inches high along it vertical centerline. Back support plates 20 and 21 are each 7 inches long and approximately 4¾ inches wide. At the fully retracted position, the back support plates are approximately ¾ of an inch from the the back 12 from the back 12, and in their extended positions the back support plates 20 and 21 can be as much as approximately 2¼ inches from back 12. Yokes 39 and 40 are approximately 2¾ inches long and approximately ½ inch in plan. The drawings are drawn to scale and therefore the dimensions of all of the linkages are in proportion to the dimensions of the above-listed parts. The back support plates 20 and 21 are considered to have an extended surface area because each has approximately 33.25 square inches of area to support a person's back.

While two plates 20 and 21 have been disclosed, it is contemplated that as many as four vertically spaced back support plates may be used, with the two additional plates being for supporting the upper back and neck regions. The linkages for moving the upper two plates can be identical to the linkages for moving plates 20 and 21. If additional plates are used, the total height of the back support unit can be increased. In addition, if necessary, the height of each back support plate can be reduced from 4.75 inches to as little as approximately two inches, which would still provide sufficient extended surface area for proper back support.

In addition, while the foregoing description has referred to a portable back support unit, it will be appreciated that the back support plates and associated linkages may be incorporated into a chair, automobile seat, or any other seating device, as a permanent part thereof.

While preferred embodiments of the present invention have been disclosed, the present invention is not limited thereto but may be otherwise embodied within the scope of the following claims.

What is claimed is:

1. An adjustable back support comprising a base, a back support plate defining a surface area for placement in contiguous relationship to a person's back, and linkage means for bodily moving said back support plate toward and away from said base while maintaining said back support plate in substantially the same orientation relative to said base in all positions of said back support plate.

2. An adjustable back support as set forth in claim 1 wherein said back support plate is relatively large as compared to the area of a person's back.

3. An adjustable back support as set forth in claim 1 wherein said back support plate is flexible.

4. An adjustable back support as set forth in claim 1 including a second back support plate vertically offset from said back support plate for defining a second surface area for placement in contiguous relationship to a person's back, and second linkage means for bodily moving said second back support plate toward and away from said base while maintaining said second back support plate in substantially the same orientation relative to said base in all positions of said second back support plate.

5. An adjustable back support as set forth in claim 4 wherein said first and second back support plates are each relatively large as compared to the area of a person's back.

6. An adjustable back support as set forth in claim 4 wherein said back support plate and said second back support plate are flexible.

7. An adjustable back support as set forth in claim 1 wherein said linkage means comprises an elongated shaft having first and second end portions, a central portion on said shaft, first and second oppositely threaded portions on said shaft on opposite sides of said central portion, first and second yokes in threaded relationship with said first and second oppositely threaded portions, respectively, first and second substantially parallel elongated links each having their first ends pivotally connected to said first yoke, third and fourth substantially parallel elongated links each having their first ends pivotally mounted relative to said base, a first pivotal connection between said first and third links, a second pivotal connection between said second and fourth links, first and second attachment means pivotally mounted on second ends of said first and second links remote from said first ends, fifth and sixth substantially parallel elongated links each having their first ends pivotally connected to said second yoke, seventh and eighth substantially parallel elongated links each having their first ends pivotally mounted relative to said base, a third pivotal connection between said fifth and seventh links, a fourth pivotal connection between said sixth and eighth links, third and fourth attachment means pivotally mounted on second ends of said fifth and sixth links, and means securing said back support plate to said first, second, third and fourth attachment means.

8. An adjustable back support as set forth in claim 7 including an adjusting knob coupled to an end portion of said shaft and extending to the side of said base.

9. An adjustable back support as set forth in claim 7 including a second back support plate vertically offset from said back support plate, and second linkage means of substantially identical construction to said linkage means for bodily moving said second back support plate toward and away from said base while maintaining said second back support plate in substantially the same orientation relative to said base in all positions of said second back support plate.

10. An adjustable back support as set forth in claim 2 wherein said base includes a rear portion and a side portion, and an adjusting knob extending laterally from said side portion and coupled to said linkage means.

11. An adjustable back support comprising a substantially vertical base, first and second vertically spaced back support plates each defining a surface area for placement in contiguous relationship to a person's back, and mechanical linkage means for positively bodily moving said first and second back support plates in their entireties independently of each other in a substantially horizontal direction toward and away from said base to thereby provide two vertically spaced surface areas entirely independent of each other at selectively variable distances from said base for supporting the back of a person.

12. An adjustable back support as set forth in claim 11 wherein said first and second back support plates are flexible.

* * * * *